US005911656A

United States Patent [19]

Futagami

[11] Patent Number: 5,911,656

[45] Date of Patent: Jun. 15, 1999

[54] AIR CUSHION WITH A FINGER-PRESSURE THERAPY LIKE EFFECT

[76] Inventor: Taneaki Futagami, 4-2-33-302, Nishikaniya, Minamiku, Hiroshimashi, Hiroshimaken, Japan

[21] Appl. No.: 08/886,587

[22] Filed: Jul. 1, 1997

[51] Int. Cl.[6] ..... A47G 9/00

[52] U.S. Cl. ..... 5/644; 5/636; 5/900.5

[58] Field of Search ..... 5/636, 652.1, 724, 5/736, 639, 900.5, 901, 933, 644

[56] References Cited

U.S. PATENT DOCUMENTS 4,614,000 9/1986 Mayer ..... 5/724 X
4,673,605 6/1987 Sias et al. ..... 5/900.5 X
4,924,541 5/1990 Inagaki ..... 5/636 X
5,153,956 10/1992 Nold ..... 5/900.5 X
5,416,936 5/1995 Chan ..... 5/933 X

*Primary Examiner*—Michael F. Trettel
*Attorney, Agent, or Firm*—Smith Patent Office

[57] ABSTRACT

A method of making a cushion which relieves muscular fatigue and improves blood circulation is disclosed. The method comprises the steps of providing round holes in an upper PVC sheet, fitting a projection into one of the round holes so that a portion of the upper PVC sheet extends over a projection base of the projection. The method also includes bonding the projection base to the upper PVC sheet using ultrasonic heating, bonding an air inlet valve to a lower PVC sheet, bonding a gusset of PVC to the upper PVC sheet and to the lower PVC sheet using ultrasonic heating, and bonding edges of the upper PVC sheet to the lower PVC sheet using ultrasonic heating.

3 Claims, 3 Drawing Sheets

AIR CUSHION WITH A FINGER-PRESSURE THERAPY LIKE EFFECT

BACKGROUND OF THE INVENTION

1. Field of the Invention

This invention relates to an air cushion with projections. The projections are bonded to the cushion with an ultrasonic heat bonder.

2. Discussion of the Related Art

The applicant has already designed and commercialized an air cushion made of conventional PVC sheet. It too has projections made of chlorinated vinyl resin bonded to it using the same ultrasonic heat method. The former cushion supports one's back firmly, and its hemispherical projections effectively improve the blood-circulation and relieve muscular fatigue. However, since the main body of the cushion was made of conventional PVC sheet, its surface was uncomfortably sticky to the touch and needed to be covered, with a lace or cotton cover. As a result, the combined price of both the original cushion along with the required cover was high, while many users also felt that the unit was heavy and carrying it was an inconvenience.

SUMMARY OF THE INVENTION

The feedback given by the users of the original cushion encouraged the inventor to develop a better cushion, without a cover. At first, a material for the main body was re-studied and a PVC sheet having a feel of suede to the touch of a human (hereafter called a suede-touch PVC sheet) was chosen. This effectively solves the problem of uncomfortable stickiness of the original design. The surface of the suede-touch PVC sheet is studded with 0.2~0.5 mm fine piles of synthetic fiber, (such as nylon). The chlorinated vinyl resin used in the hemispherical projections, has been found impossible to adhere by using the ultra-sonic heat bonder. Much research and many experiments concerning the bonding of the 2 heterogeneous materials resulted in the successful invention of a new technique for bonding the projections to the suede-touch PVC sheet.

The numbers on the figures refer to the specific parts.

1) denotes a projection.

2) denotes a base of a projection.

2*a*) denotes an outside circle of a base of a projection 2.

2*b*) denotes an inside circle of a base of a projection 2.

3) denotes a conventional PVC sheet.

4) denotes an upper sheet of a suede-touch PVC sheet.

5*a*) denotes the round hole made in the upper sheet of the suede-touch PVC sheet, manufactured by the Method-A of the present invention.

5*b*) denotes the round hole made on the upper sheet of the suede-touch PVC sheet, manufactured by the Method-B of the present invention.

6*a*) denotes the bonded part of an upper sheet of a sheet of suede-touch PVC(4) and the conventional PVC sheet(3) with projections, manufactured by Method-A of the present invention.

6*b*) denotes the bonded part of an upper sheet of a sheet of suede-touch PVC(4) and the projection base (2) manufactured by Method-B of the present invention.

7) denotes the bottom sheet of the suede-touch PVC sheet.

8) denotes the air-inlet valve of the present invention.

9) denotes the gusset of the present invention.

DETAILED DESCRIPTION OF THE PREFERRED EMBODIMENTS

The following is a detailed description of the two methods for manufacturing the presented invention: Method-A and Method-B. (One of its uses might be to provide comfort and relief while driving or traveling for an example). Although the surface of the suede-touch PVC sheet is processed with piles of synthetic fibers, (such as nylon), the reverse side is a conventional PVC sheet. Making use of that aspect, the manufacturing process are conducted as follows.

Figure 1:
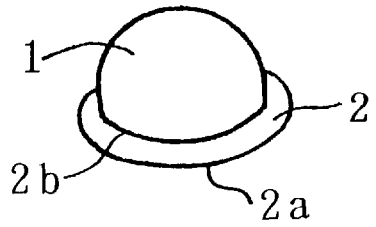
FIG. 1. is a perspective view of the projections as used in the present invention.

Method-A (a) As shown in FIG. 1, first, some projections 1 with the projection base 2 made of chlorinated vinyl resin are manufactured, leaving a cell inside in order to make the cushion light and easy to handle.

Figure 2:
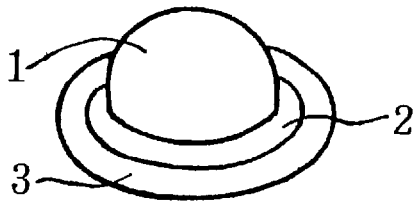
FIG. 2. is a perspective view of the PVC sheet bonded with the projection of the present invention.

(b) As shown in FIG. 2, with the conventional PVC sheet(3), some round sheets, whose radius is 0.5~1 cm longer than the projection base 2, are manufactured. Then, each sheet is bonded to the projection base 2 with the ultrasonic heat bonder. This results in producing some conventional sheets with the projection.

Figure 3A:
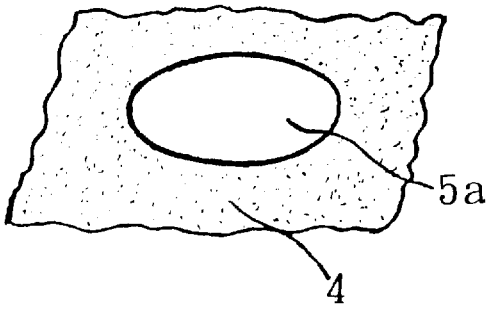
FIG. 3A. is a perspective view of the suede-touch PVC sheet with a round hole manufactured by Method-A of the present invention.

(c) As shown in FIG. 3A, some round holes 5*a* are opened on the upper sheet 4 of the suede-touch PVC sheet to fit the outside circle 2*a* of the projection base 2 of the conventional PVC sheet.

Figure 4A:
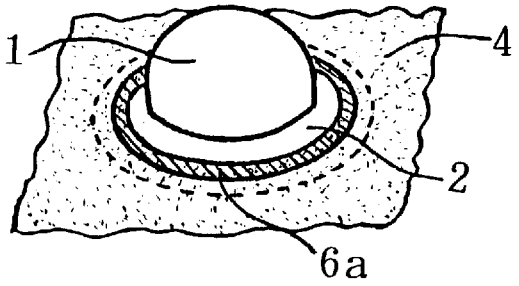
FIG. 4A. is a perspective view of the suede-touch PVC sheet with a bonded projection in it, manufactured by Method-A of the present invention.

(d) As shown in FIG. 4A, the projection 1 with the PVC sheet are inserted into the round hole 5*a* of the upper sheet 4 from the reverse side and heated up from the surface at the ring-like part of 2~3 mm width drawn with the diagonal lines in the Figure by using the ultra-sonic heat bonder. Thus, the bonded part 6*a* on the reverse side of the upper sheet 4 and the conventional PVC sheet 3 with the projections results. Also please note that the dotted line shows the conventional PVC sheet 3 outside circle, and can not be seen from the top.

Figure 5:
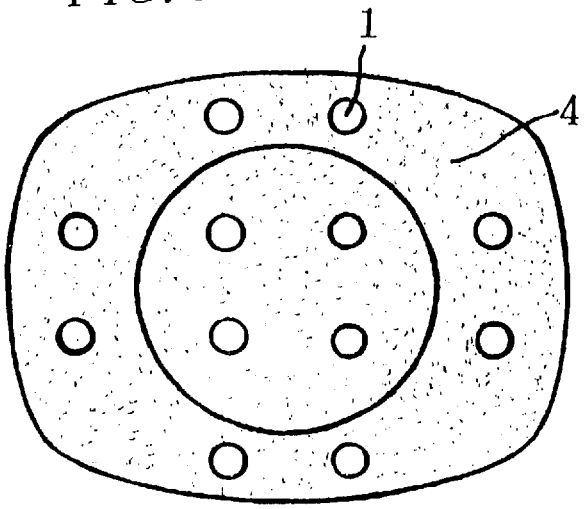
FIG. 5. is a top view of the present invention.

In addition, as shown in FIG. 5, some upper sheets with the projection on the suede-touch PVC sheets would be produced as described above.

Figure 6:
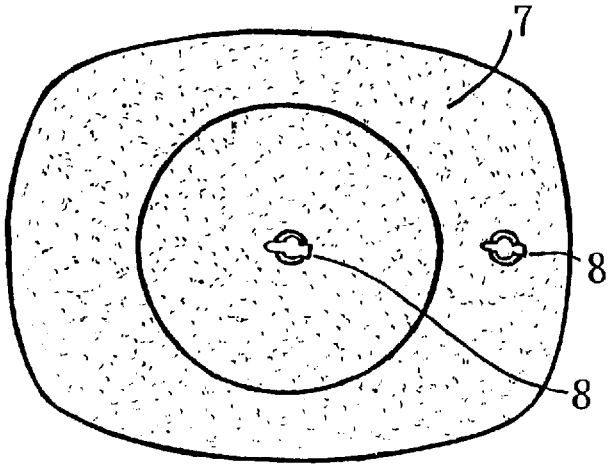
FIG. 6. is a bottom view of the present invention.

(e) As shown in FIG. 6, 2 air-inlet valves 8 would be bonded on the bottom sheet 7 made of the suede-touch PVC sheet.

Figure 7:
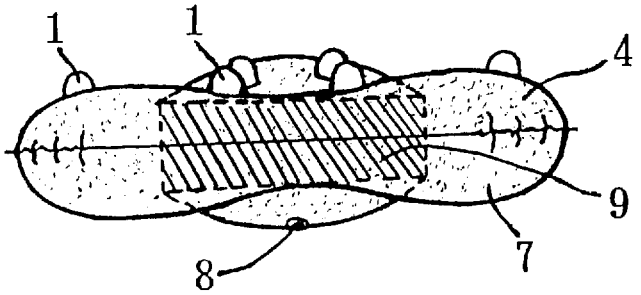
FIG. 7. is a front view of the present invention.
Figure 8:
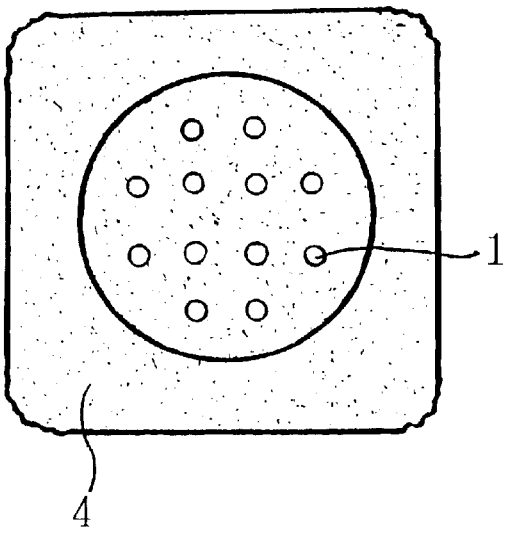
FIG. 8. is a top view of the square shaped cushion arranged according to the present invention.
Figure 9:
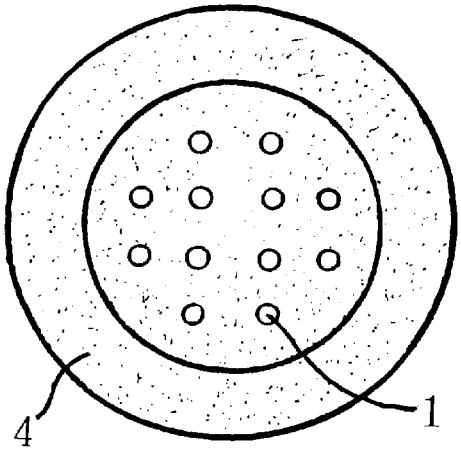
FIG. 9. is a top view of the round shaped cushion arranged according to the present invention.
Figure 10:
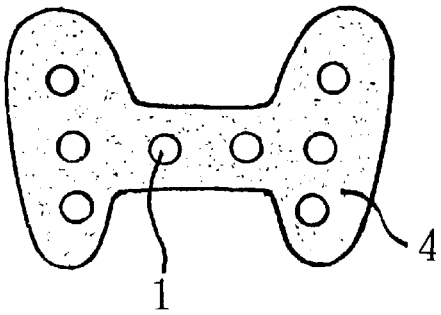
FIG. 10. is a top view of a cushion with a shape similar to the letter H arranged according to the present invention.
Figure 11:
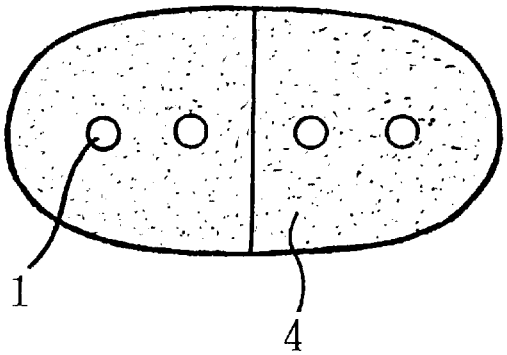
FIG. 11. is a top view of the oval shaped cushion arranged according to the present invention.
Figure 12:
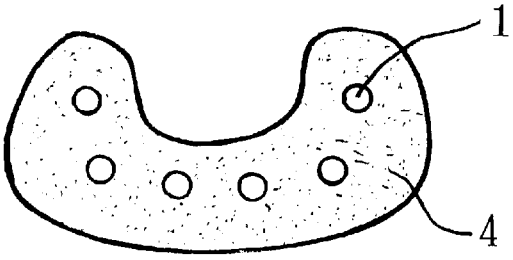
FIG. 12. is a top view of a cushion with a shape similar to the letter U arranged according the present invention.

(f) As shown with oblique lines in FIG. 7, the gussets 9 made of the conventional PVC sheet are bonded on the upper sheet 4 made of the suede-touch PVC sheet and the bottom sheet 7 made of the suede-touch PVC sheet by using the ultrasonic heat bonder. Then the rims of the top and bottom sheet are also bonded around as described above.

This method requires the initial process to bond projection base 2 to the conventional PVC sheet 3 (not to the suede-touch PVC sheet). The next description is Method-B. This method eliminates the part (b) process as described above, and leads to reduction in the manufacturing process.

Method-B (a) As shown in FIG. 1, first, some projections 1 with the projection base 2 made of chlorinated vinyl resin are manufactured, leaving a cell inside in order to make the cushion light and easy to handle.

Figure 3B:
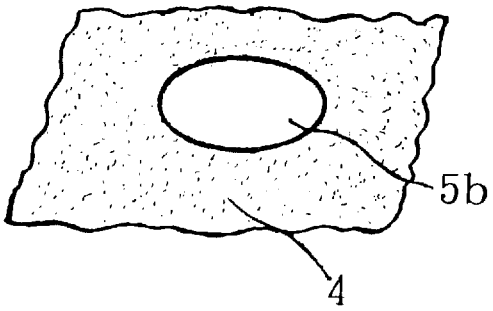
FIG. 3B. is a perspective view of the suede-touch PVC sheet with a round hole, manufactured by Method-B of the present invention.

(b) As shown in FIG. 3B, some round holes 5*b* are opened on the upper sheet 4 of the suede-touch PVC sheet to fit the inside circle 2*b* of the projection base 2.

Figure 4B:
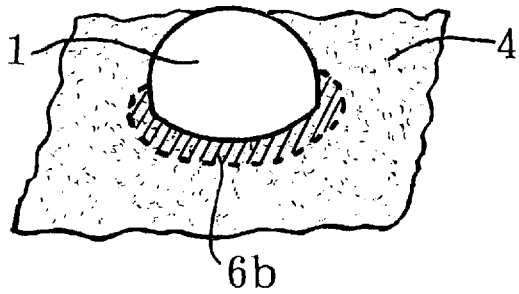
FIG. 4B. is a perspective view of the suede-touch PVC sheet with a bonded projection in it, manufactured by Method-B of the present invention.

(c) As shown with oblique lines in FIG. 4B, the projection 1 would be inserted into the round hole 5*b*. The bonded part 6*b* of the projection base 2 is bonded at the ring-like part on the upper sheet 4 of the suede-touch PVC sheet as shown with diagonal lines in the Figure. Please note that dotted line part is the outside circle 2 of the projection base 2 and can not be seen. In addition, as shown in FIG. 5, some upper sheets with the projection on the suede-touch PVC sheets are produced as described above.

(d) As shown in FIG. 6, 2 air-inlet valves 8 are bonded on the bottom sheet 7 made of the suede-touch PVC sheet.

(e) As shown in FIG. 7, the gussets 9 made of the conventional PVC sheet are bonded on the upper sheet 4 made of the suede-touch PVC sheet and the bottom sheet 7 made of the suede-touch PVC sheet by using the ultra-sonic heat bonder and then the rims of the top and bottom sheets are bonded around alike.

This method might cause to make some small space between the inside circle 2*b* of the projection base and the circumference of the round hole 5*b*. This does not cause air to leak out of the cushion, however it is advisable not to make such gaps from an aesthetic point of view. The air cushion bonded with the projections on the suede-touch PVC sheet could be produced by the two described methods A and B. The design of the cushion, size, and disposition of the projections varies depending upon the purposes for the use. FIG. 8 to FIG. 12 show various product samples. These methods make it quite flexible and allow production of many different types of cushions or products such as air-in pillow. In addition, it is possible to use magnetic projections in order to make the products more effective.

The following are the effects found by the present invention:

(1) The price is reduced compared to the prior cushions; because the new cushion does not need a cover. Thus, even without a cover, the product can avoid unpleasant stickiness, which was the main problem of the previous invention. Further the new cushion achieves a comfortable quality and a high quality. Further the new cushion achieves a comfortable quality appearance from the suede-touch PVC sheet.

(2) The present invention also meets the demands of the user looking for an air-cushion suitable for driving and traveling. That is, the user can obtain a cushion that is light and handy.

These improvements have motivated a lot of travel goods stores to vend the cushion. With the bonding technique presented here, an advantage has been achieved over the techniques used by other manufacturers. In addition to the features of conventional air cushions that add proper support for people's bodies, the present invention has succeeded in achieving a finger-pressure-therapy-like effect that improves circulation and relieves stiffness from parts of the body next to which the cushions are placed. Furthermore, due to the projections, the cushion has good ventilation and the body pressure against the cushion is dispersed evenly, allowing for prolonged use without fatigue and preventing aches.

What is claimed:

1. A cushion comprising:

a projection having a projection base attached thereto;

the projection base attached to a first PVC sheet using ultrasonic heating so as to bond them together;

a separate upper PVC sheet having round holes therein, the round holes being sized to be approximately the size of the projection base; and gussets made of PVC sheet, the gussets being attached by bonding to the separate upper PVC sheet and a separate bottom PVC sheet;

the projection base attached to the first PVC sheet so that the projection is located in one of the round holes in the separate upper PVC sheet and being attached to the separate upper PVC sheet around the one of the round holes; and wherein edges of the separate upper PVC sheet and the separate bottom PVC sheet are attached together.

2. A cushion as defined in claim 1, further comprising air inlet valves attached to the separate bottom PVC sheet using ultrasonic heating.

3. A cushion comprising:

an upper PVC sheet having round holes therein;

a projection fit into one of the round holes so that a portion of the upper PVC sheet extends over a projection base of the projection;

the projection base is attached to the upper PVC sheet using ultrasonic heating;

an air inlet valve attached to at least one of a lower PVC sheet and the upper PVC sheet;

a gusset of PVC attached to the upper PVC sheet and to the lower PVC sheet using ultrasonic heating; and edges of the upper PVC sheet are attached to edges of the lower PVC sheet using ultrasonic heating.

* * * * *